United States Patent [19]

Masumoto et al.

[11] Patent Number: 4,586,957

[45] Date of Patent: May 6, 1986

[54] IRON-BASE ALLOY MATERIALS HAVING EXCELLENT WORKABILITY

[75] Inventors: Tsuyoshi Masumoto, No. 8-22, Kamisugi 3-chome, Sendai-shi, Miyagi; Akihisa Inoue, Miyagi; Hiroyuki Tomioka, Kyoto, all of Japan

[73] Assignees: Tsuyoshi Masumoto; Unitika Ltd., both of Japan

[21] Appl. No.: 585,097

[22] Filed: Mar. 1, 1984

[30] Foreign Application Priority Data

Mar. 1, 1983 [JP] Japan ..... 58-33140

[51] Int. Cl.[4] ..... C22C 38/06; C22C 38/18; C22C 38/40

[52] U.S. Cl. ..... 75/124; 75/126 R; 75/126 B; 75/126 Q; 75/126 P; 75/128 P; 75/128 A; 75/128 C; 148/37; 148/38; 148/419

[58] Field of Search ..... 75/124 F, 124 E, 126 B, 75/128 C, 126 Q, 128 A, 124 B, 124 C, 126 R, 126 K, 128 R; 148/403, 37, 38, 419; 420/428, 584, 583

[56] References Cited

U.S. PATENT DOCUMENTS

| | | | |
|---|---|---|---|
| 2,803,538 | 8/1957 | Zampieri et al. | 75/126 Q |
| 3,859,083 | 1/1975 | Kusaka et al. | 75/128 C |
| 3,861,452 | 8/1975 | Massoubre | 428/606 |
| 3,933,441 | 4/1976 | Massoubre | 164/463 |
| 4,302,515 | 11/1981 | DeCristofaro et al. | 148/400 |
| 4,441,939 | 4/1984 | Lemkey et al. | 75/126 B |
| 4,444,587 | 4/1984 | Kelly | 75/128 A |
| 4,495,691 | 1/1985 | Masumoto et al. | 148/403 |
| 4,503,085 | 3/1985 | Dickson et al. | 148/403 |

FOREIGN PATENT DOCUMENTS

| | | | |
|---|---|---|---|
| 53-57119 | 5/1978 | Japan | 148/403 |
| 78368 | 10/1979 | Japan . | |
| 56-33442 | 4/1981 | Japan | 420/428 |

OTHER PUBLICATIONS

Japanese Patent Publication No. 3651/1981 (*Metall. Trans. A.*, 1981, vol. 12A, p. 1245).

*Primary Examiner*—L. Dewayne Rutledge
*Assistant Examiner*—Deborah Yee
*Attorney, Agent, or Firm*—Sughrue, Mion, Zinn, Macpeak and Seas

[57] ABSTRACT

Three basic types of iron-base alloys are disclosed as follows. An iron-base alloy having excellent workability comprising 2 to 60 atomic % of at least one of Ni and Mn, 7.5 to 60 atomic % of Cr, 0.5 to 12 atomic % of Al, 0.5 to 10 atomic % of at least one of C, B and P and the balance consisting substantially of Fe. An iron-base alloy having excellent workability comprising 2 to 60 atomic % of at least one of Ni and Mn, 7.5 to 60 atomic % of Cr, 1 to 15 atomic % of Si, 0.5 to 10 atomic % of at least one of C, B and P and the balance consisting substantially of Fe. Also provided is an iron-base alloy having excellent workability comprising 2 to 60 atomic % of at least one of Ni and Mn, 7.5 to 60 atomic % of Cr, 0.25 to 15 atomic % of Si, 0.5 to 10 atomic % of at least one of C, B and P, 0.02 to 0.5 atomic % of Al, and the balance consisting substantially of Fe. These Fe-base alloys are highly ductile and have high workability. By cold-working, they have very high tensile strength, and superior corrosion resistance and fatigue resistance to conventional Fe-base alloy materials. They are very useful as various industrial materials and composite materials.

19 Claims, No Drawings

IRON-BASE ALLOY MATERIALS HAVING EXCELLENT WORKABILITY

FIELD OF THE INVENTION

This invention relates to Fe-base alloy materials having excellent workability.

BACKGROUND OF THE INVENTION

Iron and steel materials containing Ni and Cr include Ni—Cr steel and stainless steels. As is well known, there are many types of stainless steels having superior corrosion resistance, weatherability, oxidation resistance, weldability, cold-workability, machinability and work-hardenability. These materials are used extensively in various chemical industries, architecture, turbines and related structures, aircraft, vehicles, etc. The stainless steels fall within four groups: austenitic, ferritic, martensitic and precipitation-hardening. Each group has its own advantages and disadvantages. For example, martensitic stainless steel has high strength and hardness. But since its Cr content is as low as about 13 atomic % or its carbon content is as high as about 3 atomic %, it has inferior corrosion resistance to austenitic and ferritic stainless steels, and also has inferior fabricability in deep drawing, cold-forging, etc. Austenitic stainless steel, in spite of its superior corrosion resistance, has a tensile strength of as low as about 60 kg/mm$^2$, and even when it is work- hardened, its strength is not great.

To increase toughness and workability, the finely divided crystal grains are treated. Unlike ordinary steels, crystal grains of austenitic stainless steel are not easily divided finely by heat-treatment. Accordingly, by hot-working, crystal grains of its fabricated articles tend to become extremely coarse, which is not desirable.

Ferritic stainless steel is less expensive than austenitic stainless steel, but is disadvantageous in respect of workability or corrosion resistance.

HH and HK steels in accordance with the standards or ACI (Alloy Casting Institute) are known as materials having increased high-temperature strength which are obtained by increasing the C content of Ni—Cr type austenitic steel. These steels do not appreciably raise a hot-workability problem. But since they are usually converted into products by casting, the productivity is low. Furthermore, because they contain a large amount of C and coarse carbide particles, they have substantially inferior creep strength and fatigue life time in thermal environment to SUS 347, etc.

Piano wires and maraging steel are metallic materials showing high tensile strength. However, since they contain coarsened carbide and precipitate particles, hot- and cold-working steps for imparting work-hardening, etc., become complex. In particular, ultrafine wires, when stretched, lack ductility, and tend to snap on elongation.

A method of producing continuous fine steel wires is disclosed in Japanese Patent Publication No. 39338/1979 (U.S. Pat. Nos. 3,861,452 and 3,933,441). These patent documents are directed to an Fe—C—Si—Mn—O alloy, and the ranges of the suitable amounts of Si and Mn are limited in order to solidify the molten state alloy in a cooling medium. For example, it is shown that steel wires could be formed from several types of examples including 97.7Fe-0.7Si-0.4Mn-1.2C and 93.5Fe-2.3Si-1.2Mn-3C. The patent documents state that since a solid silica precipitate forms upon contacting of the jetted molten steel with the cooling medium, the oxidation product acts as a hardening initiator and a hardening promoter. It is clearly described there that to obtain continuous fine steel wires, the preferred amount of Si is about 1 to 6 atomic %, and the preferred amount of Mn is about 0 to about 1.5 atomic %. These patent documents are quite silent on the properties of the steel wires produced, and merely describe alloy compositions which can give such fine steel wires.

Japanese Patent Publication (unexamined) No. 3651/1981 (*Metall. Trans. A.*, Vol. 12A, p. 1245 (1981)) discloses imparting of toughness to an $L1_2$-type intermetallic compound. Specifically, it discloses an intermetallic compound material which is composed of 3.9 to 67.0 atomic % of at least one of Ni and Mn, 7.2 to 22.5 atomic % of Al, 0.7 to 11.0 atomic % of C or 0.7 to 11.0 atomic % of C and N (not more than 0.8 atomic %), and the balance being Fe and is almost entirely made up of an $L1_2$-type intermetallic compound and in which most of C or both C and N are dissolved in the intermetallic compound. It further states that not more than 7.4 atomic % of at least one of Cr, Mo and W may be added to the above alloy and not more than 42.0 atomic % of Ni and Mn may be replaced by Co. It is further stated that not more than 3.8 atomic % of at least one of Ti, Ta, Zr, Nb and Si may be added to the alloy, and even when Cr, MO, W, Co, Ti, Ta, Zr, Nb and Si are added, the alloy material is almost entirely composed of an $L1_2$-type intermetallic compound, and most of C or C and N are dissolved in the intermetallic compound. Because of its low Cr content (not more than 7.4 atomic %), high Al content and high C content, this intermetallic compound material has an ordered structure and an inverse phase area and exhibits toughness. This intermetallic compound material has toughness only within the aforesaid composition range. When the amount of Al is less than 7.2 atomic %, no $L1_2$-type intermetallic compound is formed, and the resulting material has low strength. When it exceeds 22.5 atomic %, an $L1_2$-type intermetallic compound is formed. But its toughness is markedly reduced and it becomes brittle. When the amount of Ni is less than 3.9 atomic %, the resulting material has markedly reduced toughness owing to the formation of a carbide. When it exceeds 65.5 atomic %, $Fe_3C$ is formed and the resulting material loses toughness. When the C content is less than 0.7 atomic %, no appreciable quenching effect is observed. Hence, an $L1_2$-type intermetallic compound cannot be formed and the resulting material becomes brittle. When the C content is more than 11 atomic %, the precipitation of $Fe_3C$ is difficult to prevent even by quenching, and the resulting material remarkably loses toughness and becomes brittle. Thus, the $L1_2$ intermetallic compound material has toughness only within the aforesaid composition range, and outside this range, the precipitation of a carbide occurs, and the resulting material completely loses toughness and becomes brittle so that it is useless in practical applications. The $L1_2$-type intermetallic compound material having the above alloy composition has toughness, but is difficult to work by wire drawing, rolling, heat-treatment, etc. Moreover, an improvement in mechanical properties, etc., by working can hardly be expected. For example, an $Fe_{59.8}Ni_{16.4}Al_{14.2}C_{9.6}$ alloy material having a tensile strength of about 175 kg/mm$^2$ which is the highest among the aforesaid $L1_2$-type intermetallic compound materials contains many anti-phase boundaries and has fine anti-phase domains. Hence, even when it is subjected to some after-treatment without work-hardening, its tensile strength and yield strength cannot be improved over those of a quenched material. Furthermore, this intermetallic compound material is a non-equilibrium phase material. Hence, when it is heat-treated, for example, at 600° C. for 1 hour, anti-phase boundaries abruptly vanish and consequently anti-phase domains essential to toughness vanish. As a result, it becomes an $L1_2$-type intermetallic compound of an equilibrium phase which loses toughness, becomes brittle, and is considerably unstable thermally. In addition, the intermetallic compound material has considerably low corrosion resistance since it has a kind of boundary called an anti-phase boundary in the grains and is an ultrahigh carbon material.

SUMMARY OF THE INVENTION

It is an object of this invention to provide an Fe-base alloy having excellent workability and high toughness by promoting fine division of crystal grains and uniform dispersion of ultrafine precipitates.

Another object of this invention is to provide an Fe-base alloy having mechanical strength such as very high tensile strength and excellent corrosion resistance and fatigue resistance.

In order to achieve the above objects, the present inventors made extensive investigations, and found that when an alloy having a specified composition of Fe—(Ni, Mn)—Cr—Al—(C, B, P) is quenched from its molten state, an alloy material having excellent workability, high toughness and excellent corrosion resistance and fatigue resistance can be obtained as a result of promoted fine division of crystal grains and promoted uniform dispersion of ultrafine precipitates. Further investigations have led to the discovery that alloy materials having the same properties as above can be obtained by quenching an alloy of the above composition in which Al is replaced by a specified amount of Si, and an alloy having the above composition in which specified amounts of Al and Si are used in combination from their molten states.

Thus, the present invention provides:

an Fe-base alloy material having excellent workability comprising 2 to 60 atomic % of at least one of Ni and Mn, 7.5 to 60 atomic % of Cr, 0.5 to 12 atomic % of Al, 0.5 to 10 atomic % of at least one of C, B and P and the balance consisting substantially of Fe;

an Fe-base alloy material comprising 2 to 60 atomic % of at least one of Ni and Mn, 7.5 to 60 atomic % of Cr, 1 to 15 atomic % of Si, 0.5 to 10 atomic % of at least one of C, B and P and the balance consisting substantially of Fe; and an Fe-base alloy material having excellent workability comprising 2 to 60 atomic % of at least one of Ni and Mn, 7.5 to 60 atomic % of Cr, 0.25 to 15 atomic % of Si, 0.5 to 10 atomic % of at least one of C, B and P, 0.02 to 0.5 atomic % of Al, and the balance consisting substantially of Fe.

The Fe-base alloys having excellent workability in accordance with this invention can be cold-worked and having outstanding properties such as tensile strength and high corrosion resistance and fatigue resistance. They are very useful as various industrial materials, composite materials, filter materials, etc.

DETAILED DESCRIPTION OF THE INVENTION

The Fe-base alloys having excellent workability in accordance with this invention can be obtained by quenching an Fe-base alloy comprising 2 to 60 atomic % of at least one of Ni and Mn, 7.5 to 60 atomic % of Cr, 0.5 to 12 atomic % of Al, 0.5 to 10 atomic % of at least one of C, B and P and the balance consisting substantially of Fe (to be referred to as a first alloy); an Fe-based alloy comprising 2 to 60 atomic % of at least one of Ni and Mn, 7.5 to 60 atomic % of Cr, 1 to 15 atomic % of Si, 0.5 to 10 atomic % of at least one of C, B and P and the balance being substantially of Fe (to be referred to as a second alloy); and an alloy comprising 2 to 60 atomic % of at least one of Ni and Mn, 7.5 to 60 atomic % of Cr, 0.25 to 15 atomic % of Si, 0.5 to 10 atomic % of at least one of C, B and P, 0.02 to 0.5 atomic % of Al and the balance consisting substantially of Fe (to be referred to as a third alloy) from their molten states to quench them rapidly.

The first alloy will be described. Ni or Mn is one of those elements which are essential to the stabilization of an austenitic phase having toughness. The amount of at least one of Ni and Mn is 2 to 60 atomic %, preferably 3 to 50 atomic %. If it is less than 2 atomic % or larger than 60 atomic %, large amounts of coarsened precipitates are formed to reduce toughness and the resulting alloy is brittle and has reduced workability. Cr in the presence of Ni and Mn serves to stabilize the austenitic phase. The amount of Cr required is 7.5 to 60 atomic %, preferably 7.5 to 50 atomic %. If the Cr content is less than 7.5 atomic %, ductility and toughness are reduced, and the resulting alloy has poor workability. When the Cr content is larger than 60 atomic %, non-uniformly coarsened precipitates are formed, and the alloy becomes brittle and loses workability. The amount of Al required is 0.5 to 12 atomic %, preferably 1 to 10 atomic %. If the Al content is less than 0.5 atomic %, it is difficult to produce a material in the form of a ribbon, a tape or a fine wire directly by quenching the alloy from its molten state. If the amount of Al exceeds 12 atomic %, an Al compound is formed to reduce toughness and workability. The amount of at least one of C, B and P should be 0.5 to 10 atomic %, and preferably 0.5 to 8 atomic %. In particular, C is essential as an element forming an austenitic phase. C, B and P have an effect of facilitating rapid quenching. They respectively become a carbide, boride and phosphide, and disperse uniformly in the matrix phase to play a role of compounding and strengthening. These are essential elements for obtaining high strength. If the amount of at least one of C, B and P is less than 0.5 atomic %, a non-equilibrium phase is difficult to obtain upon quenching the molten state material. If it is larger than 10 atomic %, the precipitate becomes coarse, and the resulting alloy material becomes brittle and has reduced workability so that it is useless in practical applications.

The second alloy is the same as the first alloy in regard to the composition ranges of Ni, Mn, Cr, C, B and P except that Al is replaced by Si. Like Al, Si is an element which imparts fabricability required to obtain a ribbon, a tape and a fine wire directly by quenching from the molten state. The amount of Si required is from 1 to 15 atomic %, preferably 2 to 14 atomic %. If the amount of Si is less than 1 atomic %, it is difficult to obtain a continuous ribbon, tape or fine wire directly by quenching the alloy from its molten state. If it exceeds 15 atomic %, a silicon compound is formed to reduce toughness and workability. Si increases the toughness and hardness of the alloy material obtained by quenching the molten state material. When the mechanical properties of the alloy material are to be improved by cold rolling, cold drawing, etc., strain induced transformation occurs at a low work rate region in particular and a marked increase in strength and toughness is observed.

In the third alloy, the amount of Si can be reduced to 0.25 atomic % by adding 0.02 to 0.5 atomic % of Al. If the amount of Si in the second alloy is less than 1 atomic %, the properties of the molten alloy change, and its wetting property with ceramics, etc., which are the material for the nozzle increases. Consequently, the molten alloy has difficulty in jetting out from the nozzle. Furthermore, the direct fabricability of the alloy upon rapid quenching from the molten state is drastically reduced so that it is difficult to produce a material in the form of a continuous ribbon, tape and fine wire directly. However, when Al is added in an amount of 0.02 to 0.5 atomic %, preferably 0.03 to 0.5 atomic %, the wetting of the moletn alloy against the ceramics as the material for the nozzle is reduced and the molten material can be jetted out smoothly from the nozzle. At the same time, because of the low Si content, the direct fabricability of the alloy upon quenching and solidification is improved and a continuous ribbon, tape and fine wire can be obtained. By the addition of Al, the amount of Si can be reduced to 0.25 atomic %, preferably to 0.5 atomic %. If the amount of Si is less than 0.25 atomic %, even the addition of Al cannot lead to the direct formation of a continuous ribbon, tape and fine wire by quenching the molten state alloy. If it is larger than 15 atomic %, a silicon compound is formed which reduces toughness and workability. If the amount of Al is less than 0.02 atomic %, the properties of the molten alloy cannot be improved, and the direct fabricability by quenching from the molten state becomes inferior. If the amount of Al is larger than 0.5 atomic %, there is no effect on improving the properties of the molten alloy. Since the addition of a very small amount of Al makes it possible to decrease the amount of Si, the hardness of the resulting material is reduced and the running cost due to wearing loss of the die can be curtailed. Furthermore, the electric conductivity of the resulting material increases so that the energy loss is reduced when the material is used as an electrically conducting component part.

When having a low Ni content, a low Cr content and a low C content, the alloy materials of this invention have such a structure that ultrafine precipitates are uniformly dispersed in a mixture of a lath martensitic phase and a small amount of an austenitic phase. As the amounts of Ni, Cr and C increase, the lath martensitic phase decreases and the austenitic phase increases. Thus, the allow materials of this invention have high tensile strength, good toughness and excellent workability by the effect of the lath martensitic phase and the ultrafine precipitates are uniformly dispersed. In particular, when the alloys of this invention are worked by drawing, rolling, heat-treatment, etc., the austenitic phase is changed by strain induced transformation. As a result, their toughness can be markedly increased. Toughness and strength are increased by drawing, rolling, etc., most preferably with an alloy material comprising 3 to 40 atomic % of at least one of Ni and Mn, 7.5 to 30 atomic % of Cr, 2 to 10 atomic % of Al, 0.5 to 6 atomic % of at least one of C, B and P and the balance being Fe, an alloy material comprising 3 to 40 atomic % of at least one of Ni and Mn, 7.5 to 30 atomic % of Cr, 3 to 14 atomic % of Si, 0.5 to 6 atomic % of at least one of C, B and P, and the balance being Fe, and an alloy material comprising 3 to 40 atomic % of at least one of Ni and Mn, 7.5 to 30 atomic % of Cr, 0.5 to 14 atomic % of Si, 0.5 to 6 atomic % of at least one of C, B and P, 0.03 to 0.5 atomic % of Al, and the balance being Fe. Within the above composition ranges, the alloy materials of this invention have very good workability. The austenitic phase existing within the aforesaid composition ranges is metastable and liable to develop strain induced transformation by hard working. Specifically, the alloy materials of this invention within the aforesaid composition ranges have such a structure that ultrafine precipitates are uniformly dispersed in a mixture of the lath martensitic phase and the austenitic phase or only the lath martensitic phase or only the austenitic phase. These alloy materials have high toughness, and when worked, develop strain induced transformation. For example, they can be cold-drawn to at least 85%, and have a tensile strength of as high as at least about 400 $kg/mm^2$. The $Li_2$-type intermetallic compound (Japanese Patent Publication (unexamined) No. 3651/1981), when heat-treated, abruptly changes from a non-equilibrium state to an equilibrium state and becomes quite brittle. In contrast, when the alloy materials of this invention are heat-treated, ultrafine precipitates having a diameter of less than about 0.03 micron and formed in the uniformly dispersed state on the dislocation of the lath martensite during transition from the non-equilibrium state to the equilibrium state. This results in precipitation hardening and leads to an increase in toughness. Because of the precipitation, the non-equilibrium state cannot reach the equilibrium state. Hence, the alloy materials of this invention do not lose toughnesss and are very stable thermally in spite of being in the non-equilibrium state. This totally overturns the conventional common knowledge of the non-equilibrium phase. The precipitation-hardening action of these ultrafine precipitates having a diameter of less than about 0.03 micron is remarkable, particularly in a region having a low Ni content, a low Cr content and a low C content and including the lath martensitic phase. This action is most preferably exhibited by an alloy material comprising 3 to 20 atomic % of Ni, 7.5 to 25 atomic % of Cr, 1 to 7 atomic % of Al, 0.5 to 4 atomic % of at least one of C, B and P and the balance consisting substantially of Fe, an alloy material comprising 3 to 20 atomic % of Ni, 7.5 to 25 atomic % of Cr, 1 to 7 atomic % of Si, 0.5 to 4 atomic % of at least one of C, B and P and the balance consisting substantially of Fe, and an alloy material comprising 3 to 20 atomic % of Ni, 7.5 to 25 atomic % of Cr, 1 to 7 atomic % of Si, 0.5 to 4 atomic % of at least one of C, B and P, 0.03 to 0.5 atomic % of Al and the balance consisting substantially of Fe. Preferably, the heat-treatment temperature is about 450° to about 700° C., and the heat-treatment time is about 1 hour.

When at least one element selected from the group consisting of Nb, Ta, Ti, Mo, V, W and Cu is added to the alloy materials of this invention in an amount of 0.05 to 5 atomic %, preferably 0.1 to 4 atomic %, more preferably 0.25 to 3 atomic %, materials obtained by quenching show an improvement in toughness, corrosion resistance and oxidation resistance owing to solid solution hardening. In particular, when not more than 5 atomic % of at least one element selected from the group consisting of Nb, Ta, Ti, Mo, V, W and Cu is added to the alloy materials of this invention having the composition ranges in which the aforesaid precipitation hardening action is remarkable (i.e., within the heat-treatment conditions), precipitation hardening becomes more remarkable, and the alloy materials show higher tensile strength and toughness. If such an element is added in an amount of more than 5 atomic %, materials obtained by quenching the alloy from its molten state become brittle.

Any of the alloy systems of this invention mentioned above tolerates presence of such impurities as S, Sn, In, As, Sb, O and N in amounts normally found in most industrial materials of ordinary run. The presence of these impurities in such insignificant amounts does not impair the objects of this invention.

The alloy materials of this invention can be produced by melting the aforesaid alloy compositions in inert gas or in vacuum, and quenching the molten state materials. Quenching can be carried out by various methods. Especially effective are rapid quenching methods of the metal such as a one roll method, a twin roll method, and a spinning method in a rotating liquid (Japanese Patent Publication (unexamined) No. 165016/1981; U.S. patent application Ser. No. 254,714; European Pat. No. 39169). Alloys in the form of a plate can also be produced by a piston-anvil method, a splat quenching method, etc. The rapid quenching methods (the one roll method, the twin roll method, and the spinning method in a rotating liquid) have a cooling speed of about $10^4$ to $10^{5}$° C./sec., and the piston-anvil method and the splat quenching method have a cooling speed of about $10^5$ to $10^{6}$° C./sec. By applying these quenching methods, the alloy compositions can be efficiently quenched from its molten state.

The alloy materials of this invention can be continuously cold-worked, and by rolling and drawing, their dimensional accuracy and mechanical properties can be tremendously improved. Particularly, the alloy materials of this invention can be cold drawn more than 85% of reduction in area and easily these alloy materials can be made not more than 0.01 mm in diameter.

As required, the alloy materials may be subjected to a heat-treatment such as annealing during the working step. Such an increased cooling speed of the rapid quenching methods and the simplicity of process steps contribute to the curtailment of the cost of production and saving of energy in the production of the alloy materials of this invention.

The alloy materials so obtained have excellent workability, high tensile strength, good toughness, superior corrosion resistance, superior fatigue resistance, superior oxidation resistance, high electrical resistance and good electromagnetic properties. Because of these desirable properties, they find extensive use in various industrial materials, composite materials, materials for filters and strainers, resistors for heat generation, fibers for sound absorption, etc. The alloy materials of the present invention are thus very useful industrially.

The following examples illustrate the present invention more specifically. However, the scope of this invention is not limited to these examples.

EXAMPLES 1 TO 14 AND COMPARATIVE EXAMPLES 1 TO 8

In each run, an Fe—(Ni, Mn)—Cr—Al—(C, P, B) alloy having each of the compositions indicated in Table 1 was melted in argon gas, and jetted out under an argon gas jetting pressure of 3.5 kg/cm$^2$ by a ruby spinning nozzle having a nozzle diameter of 0.13 mm into rotating cooling water having a temperature of 6° C. and a depth of 2.5 cm and formed within a cylindrical drum having an inside diameter of 500 mm and rotating at 280 rpm, thereby quenching and solidifying it and forming a continuous fine wire having a circular cross section. At this time, the distance between the spinning nozzle and the surface of the rotating cooling water was maintained at 1 mm, and the angle of the molten metal flow jetted from the spinning nozzle to the surface of the rotating cooling water was 65°. The texture of the fine wire was observed by an X-ray diffraction, an optical microscope and a transmission electron microscope.

The fine wire was continuously cold-drawn by using commercially available diamond dies without performing intermediate annealing.

The tensile strength of the sample was measured at room temperature and a strain speed of 4.17 $10^{-4}$ sec$^{-1}$ using an Instron-type tensile tester.

The results are summarized in Table 1.

TABLE 1

| Run No. | (*) | Alloy Composition (atomic %) | | | | | Tensile Strength of the Quenched Material (kg/mm$^2$) | Structure of the Quenched Material | Cold Drawing | | Remarks |
|---|---|---|---|---|---|---|---|---|---|---|---|
| | | Ni | Cr | Al | C | Fe | | | Reduction in Area (%) | Tensile Strength (kg/mm$^2$) | |
| 1 | Comp. Ex. 1 | 1 | 10 | 6 | 3 | 80 | — | α' (lath martensitic) phase) + A (much coarsened precipitates) | Drawing impossible | — | |
| 2 | Comp. Ex. 2 | 16 | 3 | 14 | 8 | 56 | 150 | $L1_2$-type intermetallic compound | 40 | 155 | No further drawing possible |
| 3 | Ex. 1 | 8 | 7.5 | 5 | 3 | 76.5 | 185 | γ (austenitic phase) + α' + B (uniformly dispersed precipitates with a diameter of less than 0.1 micron) | 95 | 440 | Further drawable, and the strength increases. |
| 4 | Ex. 2 | 8 | 12.5 | 5 | 3 | 71.5 | 190 | γ + α' + B | 93 | 460 | Further drawable, and the strength increases. |
| 5 | Ex. 3 | 8 | 20 | 5 | 3 | 64 | 195 | γ + α' + B | 95 | 450 | Further drawable, and the strength increases. |

TABLE 1-continued

| Run No. | (*) | Alloy Composition (atomic %) | | | | | Tensile Strength of the Quenched Material (kg/mm²) | Structure of the Quenched Material | Cold Drawing Reduction in Area (%) | Cold Drawing Tensile Strength (kg/mm²) | Remarks |
|---|---|---|---|---|---|---|---|---|---|---|---|
| 6 | Ex. 4 | 15 | 40 | 2 | 3 | 40 | 170 | γ + B | 90 | 430 | Further drawable, and the strength increases. |
| 7 | Comp. Ex. 3 | 15 | 70 | 2 | 3 | 10 | — | γ + α (ferritic phase) + A | Drawing impossible | — | |
| 8 | Ex. 5 | 3 | 10 | 7 | 3 | 77 | 180 | γ + α' + B | 92 | 420 | Further drawable, and the strength increases. |
| 9 | Ex. 6 | 8 | 10 | 10 | 3 | 69 | 175 | γ + α' + B | 85 | 390 | Further drawable, and the strength increases. |
| 10 | Ex. 7 | 20 | 10 | 7 | 3 | 60 | 165 | γ + B | 93 | 400 | Further drawable, and the strength increases. |
| 11 | Ex. 8 | 40 | 10 | 7 | 3 | 40 | 150 | γ + B | 90 | 380 | Further drawable, and the strength increases. |
| 12 | Comp. Ex. 4 | 70 | 10 | 7 | 3 | 10 | — | γ + A | Drawing impossible | — | |
| 13 | Comp. Ex. 5 | 10 | 12.5 | 5 | 0.2 | 72.3 | — | Wire like sample was not obtained. | — | — | |
| 14 | Ex. 9 | 8 | 12.5 | 7 | 1 | 71.5 | 180 | γ + α' + B | 92 | 390 | Further drawable, and the strength increases. |
| 15 | Ex. 10 | 8 | 12.5 | 7 | 6 | 66.5 | 160 | γ + B | 94 | 420 | Further drawable, and the strength increases. |
| 16 | Comp. Ex. 6 | 10 | 12.5 | 5 | 13 | 59.5 | — | γ + A | Drawing impossible | — | |
| 17 | Comp. Ex. 7 | 10 | 10 | 0.1 | 3 | 76.9 | — | Wire like sample was not obtained. | — | — | |
| 18 | Comp. Ex. 8 | 52.5 | 4 | 7.6 | 8.6 | 27.3 | 110 | $L1_2$-type intermetallic compound | 25 | 140 | No further drawing possible. |
| | | Mn | Cr | Al | B | Fe | | | | | |
| 19 | Ex. 11 | 10 | 10 | 5 | 0.5 | 69.5 | 95 | γ + B | 95 | 390 | Further drawable and the strength increases. |
| 20 | Ex. 12 | 20 | 20 | 7 | 5 | 48 | 160 | γ + B | 90 | 405 | Further drawable and the strength increases. |
| | | Mn | Cr | Al | P | Fe | | | | | |
| 21 | Ex. 13 | 15 | 10 | 3 | 0.5 | 71.5 | 90 | γ + B | 95 | 380 | Further drawable and the strength increases. |
| 22 | Ex. 14 | 15 | 10 | 3 | 5 | 67 | 110 | γ + B | 90 | 400 | Further drawable and the strength increases. |

(*)Ex. = Example; Comp. Ex. = Comparative Example
The same abbreviations are used in the following tables.

The symbols showing the structures of the quenched materials (wires) in Table 1 have the following meanings.

γ: Austenitic phase
α': Lath martensitic phase
α: Ferritic phase
A: Coarsened precipitates
B: Ultrafine uniformly dispersed precipitates having a diameter of less than about 1.0 micron Runs Nos. 3 to 6, 8 to 11, 14, 15 and 19 to 22 are the alloy materials of this invention. These materials were strengthened by the lath martensitic phase and the ultrafine uniformly dispersed precipitates, and showed high strength in the form of quenched materials. When hard working is applied by cold drawing, the austenitic phase in the alloy materials of this invention undergoes strain induced transformation, and the materials had high strengths of about 400 kg/mm². However, the $L1_2$-type intermetallic compound materials in Runs Nos. 2 and 18 could be cold-drawn only to a reduction in area of about 20 to about 40%. When cold drawing was performed to a higher reduction, breakage frequently occurred and the drawing became impossible. In addition, the drawing did not cause work hardening, and these materials were scarcely improved with regard to mechanical properties such as tensile strength. The alloy materials in Runs Nos. 1, 12 and 16 were very brittle and could not be cold-drawn because coarsened precipitates existed in the lath martensitic phase or the austenitic phase. With the alloy materials of Runs Nos. 13 and 17 fine wire-like samples could not be obtained because the amounts of C and Al added were small and the materials had no quenching ability and fine wireforming ability.

EXAMPLES 15 TO 29 AND COMPARATIVE EXAMPLES 9 TO 16

In these examples, the effect of adding an element M selected from Nb, Ta, Ti, Mo, V, W and Cu to an Fe—Ni—Cr—Al—C alloy was examined. In each run, a continuous fine wire having a diameter of about 80 to about 130 microns was produced by the same apparatus and under the same conditions as in Example 1. The tensile strength and 180° bending property of the wire were determined. An increase in tensile strength upon tempering at 550° C. for 1 hour is shown in Table 2.

TABLE 2

| Run No. | (*) | Alloy Composition (atomic %) Ni | Cr | Al | C | M | Fe | Quenched Material: In the Case of Not Adding the Additive Element M, Tensile Strength (kg/mm²) | Quenched Material: In the Case of Adding the Additive Element M, Tensile Strength (kg/mm²) | Quenched Material: In the Case of Adding the Additive Element M, 180° Bending Property | Tempered Material: In the Case of Not Adding Element M, Tensile Strength (kg/mm²) | Tempered Material: In the Case of Adding Element M, Tensile Strength (kg/mm²) | Tempered Material: In the Case of Adding Element M, 180° Bending Property |
|---|---|---|---|---|---|---|---|---|---|---|---|---|---|
| 23 | Ex. 15 | 3 | 10 | 7 | 1 | 1 Nb | 78 | 195 | 205 | Good | 205 | 260 | Good |
| 24 | Ex. 16 | 18 | 10 | 7 | 1 | 1 Nb | 63 | 160 | 165 | Good | 170 | 230 | Good |
| 25 | Ex. 17 | 10 | 7.5 | 7 | 1 | 1 Nb | 73.5 | 190 | 195 | Good | 200 | 265 | Good |
| 26 | Ex. 18 | 10 | 25 | 7 | 1 | 1 Nb | 56 | 175 | 185 | Good | 195 | 250 | Good |
| 27 | Ex. 19 | 10 | 10 | 1 | 1 | 1 Nb | 77 | 165 | 170 | Good | 170 | 210 | Good |
| 28 | Ex. 20 | 10 | 10 | 7 | 1 | 1 Nb | 71 | 170 | 175 | Good | 180 | 270 | Good |
| 29 | Ex. 21 | 10 | 12.5 | 5 | 0.5 | 1 Nb | 71 | 190 | 195 | Good | 200 | 240 | Good |
| 30 | Ex. 22 | 10 | 12.5 | 5 | 4 | 1 Nb | 62.5 | 160 | 170 | Good | 185 | 255 | Good |
| 31 | Ex. 23 | 10 | 12.5 | 5 | 1 | 3 Nb | 68.5 | 180 | 195 | Good | 195 | 280 | Good |
| 32 | Comp. Ex. 9 | 10 | 12.5 | 5 | 1 | 7 Nb | 64.5 | " | — | Poor | — | — | — |
| 33 | Ex. 24 | 10 | 12.5 | 5 | 1 | 2 Ta | 69.5 | " | 190 | Good | 195 | 260 | Good |
| 34 | Comp. Ex. 10 | 10 | 12.5 | 5 | 1 | 6 Ta | 65.5 | " | — | Poor | — | — | — |
| 35 | Ex. 25 | 10 | 12.5 | 5 | 1 | 2 Ti | 69.5 | " | 185 | Good | 195 | 240 | Good |
| 36 | Comp. Ex. 11 | 10 | 12.5 | 5 | 1 | 6 Ti | 65.5 | " | — | Poor | — | — | — |
| 37 | Ex. 26 | 10 | 12.5 | 5 | 1 | 2 Mo | 69.5 | " | 185 | Good | 195 | 235 | Good |
| 38 | Comp. Ex. 12 | 10 | 12.5 | 5 | 1 | 6 Mo | 65.5 | " | — | Poor | — | — | — |
| 39 | Ex. 27 | 10 | 12.5 | 5 | 1 | 2 V | 69.5 | " | 185 | Good | 195 | 225 | Good |
| 40 | Comp. Ex. 13 | 10 | 12.5 | 5 | 1 | 6 V | 65.5 | " | — | Poor | — | — | — |
| 41 | Ex. 28 | 10 | 12.5 | 5 | 1 | 2 W | 69.5 | " | 190 | Good | 195 | 230 | Good |
| 42 | Comp. Ex. 14 | 10 | 12.5 | 5 | 1 | 6 W | 65.5 | " | — | Poor | — | — | — |
| 43 | Ex. 29 | 10 | 12.5 | 5 | 1 | 3 Cu | 68.5 | " | 185 | Good | 195 | 225 | Good |
| 44 | Comp. Ex. 15 | 10 | 12.5 | 5 | 1 | 7 Cu | 64.5 | " | — | Poor | — | — | — |
| 45 | Comp. Ex. 16 | 16.5 | 2.8 | 14.4 | 8.1 | 1 Nb | 57.2 | 150 | 155 | Good | (Unmeasurable) | | Poor |

TABLE 3

| Run No. | (*) | Alloy Composition (atomic %) Ni | Cr | Al | Si | C | M | Fe | Quenched Material: Element M Not Added, Tensile Strength (kg/mm²) | Quenched Material: Element M Added, Tensile Strength (kg/mm²) | Quenched Material: Element M Added, 180° Bending Property | Tempered Material: Element M Not Added, Tensile Strength (kg/mm²) | Tempered Material: Element M Added, Tensile Strength (kg/mm²) | Tempered Material: Element M Added, 180° Bending Property |
|---|---|---|---|---|---|---|---|---|---|---|---|---|---|---|
| 46 | Ex. 30 | 10 | 10 | — | 7 | 1 | 0.5 Mo | 71.5 | 185 | 190 | Good | 205 | 220 | Good |
| 47 | Comp. Ex. 17 | 10 | 10 | — | 7 | 1 | 6 Mo | 66 | " | — | Poor | — | — | — |
| 48 | Ex. 31 | 10 | 10 | — | 7 | 1 | 1 Nb | 71 | " | 195 | Good | 205 | 230 | Good |
| 49 | Comp. Ex. 18 | 10 | 10 | — | 7 | 1 | 7 Nb | 65 | " | — | Poor | — | — | — |
| 50 | Ex. 32 | 10 | 10 | — | 7 | 1 | 1 Ta | 71 | " | 195 | Good | 205 | 235 | Good |
| 51 | Comp. Ex. 19 | 10 | 10 | — | 7 | 1 | 6 Ta | 66 | " | — | Poor | — | — | — |
| 52 | Ex. 33 | 10 | 10 | — | 1.5 | 1 | 0.5 Mo | 77 | 165 | 175 | Good | 180 | 200 | Good |
| 53 | Ex. 34 | 8 | 10 | 0.03 | 1.5 | 1 | 1 Mo | 78.47 | 160 | 170 | Good | 180 | 205 | Good |
| 54 | Ex. 35 | 8 | 10 | 0.5 | 7 | 1 | 1 Mo | 72.5 | 180 | 190 | Good | 195 | 220 | Good |

Furthermore, in order to examine the effect of adding an element M selected from Nb, Ta and Mo to an Fe—Ni—Cr—Si—C alloy or an Fe—Ni—Cr—(Al, Si)—C alloy, a continuous fine wire having a diameter of 80 to 130 microns was produced in each run by the same apparatus and under the same conditions as in Example 1. The tensile strength and 180° bending property of the wire were determined. An increase in tensile strength upon tempering at 550° C. for 1 hour is shown in Table 3.

Runs Nos. 23 to 31, 33, 35, 37, 39, 41, 43, 46, 48, 50 and 52 to 54 are the alloy materials of the present invention. As a result of adding a small amount of an element M selected from Nb, Ta, Ti, Mo, V, W and Cu, an increase in tensile strength of 5 to 15 kg/mm² was noted in the quenched materials by solid solution hardening while they retained toughness. Examination of the tempered materials by a transmission electron microscope showed that in addition to the ultrafine precipitates in the quenched materials, much finer precipitates having a diameter of less than about 0.03 micron formed anew in the uniformly dispersed state. Since a material produced by rapid quenching method has no segregation, precipitates generated by heat-treatment are ultrafine as are precipitates generated upon rapid quenching. In particular, ultrafine precipitates formed uniformly are not present in the brittle equilibrium phase in the alloy materials of this invention. Accordingly, these materials do not lose any of their toughness, and by precipitation hardening, their tensile strength is increased by about 30 to 90 kg/mm$^2$.

The non-equilibrated $L1_2$-type intermetallic compound material obtained by rapid quenching in Run No. 45 did not experience precipitation, etc., in contrast to the alloy materials of this invention, and by tempering, the non-equilibrium phase abruptly changed to an equilibrium phase. Consequently, the material became quite brittle and was thermally unstable.

In Runs Nos. 32, 34, 36, 38, 40, 42, 44, 47, 49 and 51, the amount of M selected from Nb, Ta, Ti, Mo, V, W and Cu exceeded a suitable amount which could dissolve in the alloy. Hence, the element M could not dissolve and brittle precipitates corresponding to M formed. Hence, the materials lost toughness and became useless in practical applications.

EXAMPLES 36 TO 51 AND COMPARATIVE EXAMPLES 20 TO 27

In each run, an Fe—(Ni, Mn)—Cr—(Al, Si)—C or an Fe—(Ni, Mn)—Cr—(Al, Si)—C—Mo alloy having each of the compositions shown in Table 4 was melted, spun and drawn by the same apparatus under the same conditions as in Example 1 to form a continuous filament having a diameter of about 130 microns. By the same method as in Example 1, its tensile strength and 180° bending property were examined. The results are shown in Table 4.

TABLE 4

| Run No. | (*) | Alloy Composition (atomic %) Ni | Mn | Cr | Al | Si | C | Mo | Fe | Tensile Strength of the Quenched Material (kg/mm$^2$) | Structure of the Quenched Material (the symbols have the same meanings as in Table 1) | Cold Drawing Reduction in Area (%) | Tensile Strength (kg/mm$^2$) | Remarks |
|---|---|---|---|---|---|---|---|---|---|---|---|---|---|---|
| 55 | Comp. Ex. 20 | 8 | — | 12.5 | — | 0.5 | 4 | — | 75 | — | A wire-like sample could not be obtained. | — | — | |
| 56 | Ex. 36 | 8 | — | 12.5 | — | 2 | 4 | — | 73.5 | 175 | $\gamma + B$ | 91 | 405 | Could be further drawn with an increase in strength. |
| 57 | Ex. 37 | 8 | — | 12.5 | — | 2 | 4 | 0.5 | 73 | 180 | $\gamma + B$ | 90 | 410 | Could be further drawn with an increase in strength. |
| 58 | Ex. 38 | 8 | — | 12.5 | — | 7 | 4 | — | 68.5 | 180 | $\gamma + B$ | 93 | 430 | Could be further drawn with an increase in strength. |
| 59 | Ex. 39 | 8 | — | 12.5 | — | 7 | 4 | 0.5 | 68 | 190 | $\gamma + B$ | 92 | 430 | Could be further drawn with an increase in strength. |
| 60 | Ex. 40 | 8 | — | 12.5 | — | 12 | 4 | — | 63.5 | 185 | $\gamma + B$ | 90 | 410 | Could be further drawn with an increase in strength. |
| 61 | Ex. 41 | 8 | — | 12.5 | — | 12 | 4 | 0.5 | 63 | 195 | $\gamma + B$ | 88 | 415 | Could be further drawn with an increase in strength. |
| 62 | Comp. Ex. 21 | 8 | — | 12.5 | — | 18 | 4 | — | 57.5 | — | $\gamma + A$ | — | — | |
| 63 | Comp. Ex. 22 | 8 | — | 12.5 | — | 7 | 0.3 | — | 72.2 | — | A wire-like sample could not be obtained. | — | — | |
| 64 | Ex. 42 | 8 | — | 12.5 | — | 7 | 2 | — | 70.5 | 185 | $\gamma + \alpha' + B$ | 89 | 405 | Could be further drawn with an increase in strength. |
| 65 | Ex. 43 | 8 | — | 12.5 | — | 7 | 6 | — | 66.5 | 200 | $\gamma + B$ | 91 | 415 | Could be further drawn with an increase in |

TABLE 4-continued

| Run No. | (*) | Alloy Composition (atomic %) Ni | Mn | Cr | Al | Si | C | Mo | Fe | Tensile Strength of the Quenched Material (kg/mm²) | Structure of the Quenched Material (the symbols have the same meanings as in Table 1) | Cold Drawing Reduction in Area (%) | Tensile Strength (kg/mm²) | Remarks |
|---|---|---|---|---|---|---|---|---|---|---|---|---|---|---|
| | | | | | | | | | | | | | | strength. |
| 66 | Comp. Ex. 23 | 8 | — | 12.5 | — | 7 | 12 | — | 60.5 | — | γ + A | Drawing impossible | — | |
| 67 | Comp. Ex. 24 | 8 | — | 12.5 | 0.01 | 0.1 | 4 | — | 75.39 | — | A wire-like sample could not be obtained. | — | — | |
| 68 | Ex. 44 | 8 | — | 12.5 | 0.03 | 0.5 | 4 | — | 74.97 | 155 | γ + B | 90 | 415 | Could be further drawn with an increase in strength. |
| 69 | Ex. 45 | 8 | — | 12.5 | 0.05 | 5 | 4 | — | 70.45 | 185 | γ + B | 91 | 420 | Could be further drawn with an increase in strength. |
| 70 | Ex. 46 | 8 | — | 12.5 | 0.05 | 5 | 4 | 0.5 | 69.95 | 190 | γ + B | 90 | 425 | Could be further drawn with an increase in strength. |
| 71 | Ex. 47 | 8 | — | 12.5 | 0.5 | 12 | 4 | — | 63 | 190 | γ + B | 91 | 435 | Could be further drawn with an increase in strength. |
| 72 | Ex. 48 | 8 | — | 12.5 | 0.5 | 12 | 4 | 0.5 | 62.5 | 195 | γ + B | 89 | 420 | Could be further drawn with an increase in strength. |
| 73 | Comp. Ex. 25 | 8 | — | 12.5 | 1 | 18 | 4 | — | 56.5 | — | γ + A | Drawing impossible | — | |
| 74 | Ex. 49 | — | 10 | 12.5 | 0.1 | 4 | 4 | — | 69.4 | 130 | γ + B | 88 | 395 | Could be further drawn with an increase in strength. |
| 75 | Ex. 50 | — | 10 | 12.5 | 0.5 | 8 | 4 | — | 65 | 155 | γ + B | 90 | 400 | Could be further drawn with an increase in strength. |
| 76 | Ex. 51 | — | 10 | 12.5 | 0.5 | 8 | 4 | 0.5 | 64.5 | 165 | γ + B | 89 | 405 | Could be further drawn with an increase in strength. |
| 77 | Comp. Ex. 26 | — | 10 | 12.5 | 0.01 | 0.1 | 4 | — | 73.39 | — | A wire-like sample could not be obtained. | — | — | |
| 78 | Comp. Ex. 27 | — | 10 | 12.5 | 1 | 18 | 4 | — | 54.5 | — | γ + A | Drawing impossible | — | |

Runs Nos. 56 to 61, 64, 65, 68 to 72, and 74 to 76 are the alloy materials of this invention and had such a structure that fine precipitates dispersed in an austenitic phase and in a mixture of the austenitic phase and the lath martensitic phase. The alloy materials of this invention developed a strain induced transformation by cold drawing, and by fiber strengthening of crystal grains, the effect of adding Mo, etc., showed very high tensile strength. In Run No. 55, the amount of Si was below the suitable value, and the cohesive force of the molten alloy in the cooling medium was reduced. Hence, the alloy had poor wire-forming ability and a fine wire was difficult to obtain continuously. In Runs Nos. 67 and 77, an attempt was made to improve the properties of the molten alloy and obtain a continuous wire by adding Al, but since the amounts of both Al and Si were below the suitable values, a continuous wire could not be obtained. The continuous wires obtained in Runs Nos. 62, 73 and 78 were brittle and useless in practical applications because the amount of Si was too large. The continuous wire obtained in Run No. 66 was brittle and useless in practical applications because the amount of C was too large. In Run No. 63, the amount of C was below the suitable value, and a non-equilibrium phase and a wire-like sample could not be obtained.

EXAMPLES 52 TO 57 AND COMPARATIVE EXAMPLES 28 AND 29

To examine the corrosion resistance of an Fe—Ni—Cr—(Al, Si)—C—Mo alloy, a fine wire having a diameter of about 80 to 130 microns was produced by the same apparatus and under the same conditions as in Example 1. The corrosion resistance of the wire material was examined by an AC impedance method using an AC impedance corrosion resistance tester (made by Riken Densi Co., Ltd.). This method of measuring corrosion resistance is an accelerated test which comprises immersing the sample as an electrode in a given corrosive liquid, passing an electric current intermittently for a certain period of time and determining the amount of corrosion from its resistance value (see Shiro Haruyama and Tohru Mizunagare: Metal Physics Seminar, Vol. 4, No. 2, 1979, and S. Haruyama: Proc. 5th Int. Cong. Metallic Corr., Tokyo (1972) 82).

The results are shown in Table 5.

TABLE 5

| Run No. | (*) | Alloy Composition (atomic %) Ni | Cr | Al | Si | C | Mo | Fe | Wire Diameter (μm) | Tensile Strength (kg/mm²) | Corrosion Resistance (30° C.) 0.5 N HCl (mm/year) | 3 N $HNO_3$ (mm/year) | Remarks |
|---|---|---|---|---|---|---|---|---|---|---|---|---|---|
| 79 | Ex. 52 | 8 | 7.5 | 5 | — | 4 | — | 75.5 | 30 | 415 | 0.7 | 0 | After cold drawing 92% |
| 80 | Ex. 53 | 10 | 15 | 5 | — | 4 | — | 66 | 30 | 405 | 0.5 | 0 | After cold drawing 91% |
| 81 | Ex. 54 | 8 | 7.5 | 5 | — | 4 | 0.5 | 75 | 30 | 430 | 0.4 | 0 | After cold drawing 92% |
| 82 | Ex. 55 | 8 | 7.5 | 5 | — | 4 | 1 | 74.5 | 30 | 420 | 0.3 | 0 | After cold drawing 90% |
| 83 | Ex. 56 | 8 | 7.5 | — | 2 | 4 | 0.5 | 78 | 30 | 425 | 0.4 | 0 | After cold drawing 91% |
| 84 | Ex. 57 | 8 | 7.5 | — | 8 | 4 | 0.5 | 72 | 30 | 435 | 0.4 | 0 | After cold drawing 89% |
| 85 | Comp. Ex. 28 | Piano wire | | | | | | | 130 | 320 | 17 | 25 | SWRS-82A, SWPA |
| 86 | Comp. Ex. 29 | Stainless steel wire | | | | | | | 120 | 100 | 0.7 | 0 | SUS 304-W1 |

Runs Nos. 79 to 84 are the alloy materials of this invention. By the effects of Ni, Cr, Al, Si, Mo, and of fine crystal grains, they have superior corrosion resistance and very high strength. Run No. 85 is a conventional piano wire which has been frequently used heretofore. It has no corrosion resistance and its strength is much lower than that of the alloy material of this invention. The stainless steel wire in Run No. 86 has corrosion resistance equivalent to that of the alloy of this invention, but its strength is less than one-fourth of that of the alloy of this invention.

EXAMPLES 58 TO 63 AND COMPARATIVE EXAMPLES 30 AND 31

The fatigue resistance of an Fe—Ni—Cr—(Al, Si)—C alloy or an Fe—Ni—Cr—(Al, Si)—C—Mo alloy was examined. A fine wire having a diameter of about 30 microns was produced from it by the same apparatus and under the same conditions as in Example 1. The fatigue resistance of the fine wire was examined by using a roller bending type fatique tester. While a surface stress was applied to the fine wire by a roller, the relation between the number of bendings until breakage and the surface strain was measured. The fatique limit, i.e., the stress under which the wire did not break was measured. The results are shown in Table 6.

TABLE 6

| Run No. | (*) | Alloy Composition (atomic %) Ni | Cr | Al | Si | C | Mo | Fe | Wire Diameter (μm) | Fatigue Limit (%) | Remarks |
|---|---|---|---|---|---|---|---|---|---|---|---|
| 87 | Ex. 58 | 8 | 12.5 | 5 | — | 3 | — | 76.5 | 30 | 0.45 | After cold drawing |
| 88 | Ex. 59 | 8 | 12.5 | 7 | — | 3 | — | 74.5 | 30 | 0.43 | " |
| 89 | Ex. 60 | 8 | 12.5 | 5 | — | 5 | — | 74.5 | 30 | 0.42 | " |
| 90 | Ex. 61 | 8 | 12.5 | 5 | — | 5 | 0.5 | 74 | 30 | 0.56 | " |
| 91 | Ex. 62 | 8 | 12.5 | — | 4 | 4 | — | 71.5 | 30 | 0.44 | " |
| 92 | Ex. 63 | 8 | 12.5 | — | 6 | 4 | 0.5 | 69 | 30 | 0.46 | " |
| 93 | Comp. Ex. 30 | Piano wire | | | | | | | 130 | 0.40 | SWRS-82A, SWPA |
| 94 | Comp. Ex. 31 | Stainless steel wire | | | | | | | 120 | 0.39 | SUS 304-W1 |

Runs Nos. 87 to 92 are the alloy materials of this invention which have been found to have high toughness and superior fatigue resistance owing to the effects of the strain induced transformation, fibriform crystal grains and ultrafine precipitates. Runs Nos. 93 and 94 show a commercially available piano wire and stainless steel wire which have lower fatigue limits than the alloy materials of this invention, and cannot be said to be materials having superior fatigue resistance.

While the invention has been described in detail and with reference to specific embodiments thereof, it will be apparent to one skilled in the art that various changes and modifications can be made therein without departing from the spirit and scope thereof.

What is claimed is:

1. An Fe—Cr alloy material having excellent workability, consisting essentially of:

2 to 60 atomic percent of at least one metal selected from the group consisting of Ni and Mn;

7.5 to 60 atomic % of Cr;

0.5 to 12 atomic % of Al;

0.5 to 10 atomic % of at least one element selected from the group consisting of C, B, and P; and the balance consisting substantially of Fe;

wherein said alloy material has a texture of a non-equilibrium crystalline phase.

2. An Fe—Cr alloy material as claimed in claim 1, wherein the metal selected from the group consisting of Ni and Mn is present in an amount in the range of 3 to 50 atomic %.

3. An Fe—Cr alloy material as claimed in claim 1, wherein the Cr is present in an amount in the range of 7.5 to 50 atomic %.

4. An Fe—Cr alloy material as claimed in claim 1, wherein the Al is present in an amount in the range of 1 to 10 atomic %.

5. An Fe—Cr alloy material as claimed in claim 1, wherein the element selected from the group consisting of C, B and P is present in an amount in the range of 0.5 to 8 atomic %.

6. An Fe—Cr alloy material having excellent workability, consisting essentially of:

2 to 60 atomic % of at least one metal selected from the group consisting of Ni and Mn;
7.5 to 60 atomic % of Cr;
1 to 15 atomic % of Si;
0.5 to 10 atomic % of at least one element selected from the group consisting of C, B and P; and
the balance consisting substantially of Fe;
wherein said alloy material has a texture of a non-equilibrium crystalline phase.

7. An Fe—Cr alloy material as claimed in claim 6, wherein the Si is present in an amount in the range of 2 to 14 atomic %.

8. An Fe—Cr alloy material having excellent workability, consisting essentially of:

2 to 60 atomic % of at least one metal selected from the group consisting of Ni and Mn;
7.5 to 60 atomic % of Cr;
0.25 to 15 atomic % of Si;
0.5 to 10 atomic % of at least one element selected from the group consisting of C, B, and P;
0.02 to 0.5 atomic % of Al; and
the balance consisting substantially of Fe;
wherein said alloy material has a texture of a non-equilibrium crystalline phase.

9. An Fe—Cr alloy material as claimed in claim 8, wherein the Al is present in an amount in the range of 0.03 to 0.5 atomic %.

10. An Fe—Cr alloy material as claimed in claim 8, wherein the Si is present in an amount in the range of 0.5 to 15 atomic %.

11. An Fe—Cr alloy material as claimed in claim 1, wheren the metal selected from the group consisting of Ni and Mn is present in an amount in the range of 3 to 40 atomic %, the Cr is present in an amount in the range of 7.5 to 30 atomic %, the Al is present in an amount in the range of 2 to 10 atomic %, and the element selected from the group consisting of C, B and P is present in an amount in the range of 0.5 to 6 atomic %.

12. An Fe—Cr alloy material as claimed in claim 6, wherein the metal selected from the group consisting of Ni and Mn is present in an amount in the range of 3 to 40 atomic %, the Cr is present in an amount in the range of 7.5 to 30 atomic %, the Si is present in an amount in the range of 3 to 14 atomic %, and the element selected from the group consisting of C, B and P is present in an amount in the range of 0.5 to 6 atomic %.

13. An Fe—Cr alloy material as claimed in claim 8, wherein the metal selected from the group consisting of Ni and Mn is present in an amount in the range of 3 to 40 atomic %, the Cr is present in an amount in the range of 7.5 to 30 atomic %, the Si is present in an amount in the range of 0.5 to 14 atomic %, the element selected from the group consisting of C, B and P is present in an amount in the range of 0.5 to 6 atomic % and the Al is present in an amount in the range of 0.03 to 0.5 atomic %.

14. An Fe—Cr alloy material as claimed in claim 1, further comprising:

at least one element selected from the group consisting of Nb, Ta, Ti, Mo, V, W and Cu in an amount in the range of 5 atomic % or less.

15. An Fe—Cr alloy material as claimed in claim 6, further comprising:

at lease one element selected from the group consisting of Nb, Ta, Ti, Mo, V, W and Cu in an amount in the range of 5 atomic % or less.

16. An Fe—Cr alloy material as claimed in claim 8, further comprising:

at least one element selected from the group consisting of Nb, Ta, Ti, Mo, V, W and Cu in an amount in the range of 5 atomic % or less.

17. An Fe—Cr alloy material as claimed in claim 1, said alloy having ultra-fine carbide precipitates uniformly dispersed in a lath martensitic matrix, an austenitic matrix, or a lath martensitic and austenitic matrix.

18. An Fe—Cr alloy material as claimed in claim 6, said alloy having ultra-fine carbide precipitates uniformly dispersed in a lath martensitic matrix, an austenitic matrix, or a lath martensitic and austenitic matrix.

19. An Fe—Cr alloy material as claimed in claim 8, said alloy having ultra-fine carbide precipitates uniformly dispersed in a lathm artensitic matrix, an austenitic matrix, or a lath martensitic and austenitic matrix.

* * * * *